United States Patent [19]

Lazar et al.

[11] Patent Number: 4,889,500

[45] Date of Patent: Dec. 26, 1989

[54] CONTROLLED IMPEDANCE CONNECTOR ASSEMBLY

[75] Inventors: Michael Lazar, White Plains, N.Y.; Rocco Noschese, Wilton, Conn.

[73] Assignee: Burndy Corporation, Norwalk, Conn.

[21] Appl. No.: 197,775

[22] Filed: May 23, 1988

[51] Int. Cl.[4] ..... H01R 17/18

[52] U.S. Cl. ..... 439/579; 439/98; 439/63; 439/364

[58] Field of Search ..... 439/92, 98, 99, 101, 439/578–585, , 55, 63, 540, 43–49, 51–54, 607–610, 364

[56] References Cited

U.S. PATENT DOCUMENTS

| | | | |
|---|---|---|---|
| 3,128,138 | 4/1964 | Noschese | 439/579 |
| 3,243,760 | 3/1966 | Dupre et al. | 439/579 |
| 3,591,834 | 7/1971 | Kolias | 339/17 M |
| 3,848,164 | 11/1974 | Otte | 439/579 |
| 4,109,993 | 8/1978 | Bauerle | 439/695 |
| 4,699,590 | 10/1987 | Farrar et al. | 439/95 |
| 4,708,666 | 11/1987 | Fisher, Jr. | 439/98 |
| 4,710,133 | 12/1987 | Lindeman | 439/92 |
| 4,775,333 | 10/1988 | Grider et al. | 439/736 |

OTHER PUBLICATIONS (10 pp.), from Burndy Master Catalog, vol. II entitled "The Connector Selector", published by Burndy Corporation, 1986.

*Primary Examiner*—David Pirlot

*Attorney, Agent, or Firm*—Perman & Green

[57] ABSTRACT

A connector assembly enables a dense grouping of contacts to be joined in one step to a printed circuit board (PCB) while assuring that impedances are matched among all components. A receptacle intended for mounting on the PCB matingly receives a plug which carries terminal contacts of multiple coaxial cable leads. The plug includes a honeycomb grounding block to engageably receive the outer conductor of each coaxial terminal, an inner conductive sleeve being electrically coupled to a signal lead by a first contact. Signal pin contacts within the receptacle and electrically coupled with the PCB are electrically coupled with each inner conductive sleeve when the plug is inserted into the receptacle. Likewise, ground pin contacts within the receptacle and electrically coupled with the PCB have second and third spaced resilient contacts, respectively, engaging the grounding block at distances farther from the nearer to the PCB than the first contacts. As the plug moves toward engagement with the receptacle, the ground pin contacts first move into engagement with the grounding block to initially discharge static electricity. Thereupon, the signal pin contacts engage associated inner sleeves of the coaxial terminals. In its final position within the receptacle, the ground pin contacts engage the grounding block nearer the PCB thant the location of engagement between the signal pin contacts and their associated inner sleeves thereby minimizing the possibility of ground loops.

45 Claims, 9 Drawing Sheets

CONTROLLED IMPEDANCE CONNECTOR ASSEMBLY

BACKGROUND OF THE INVENTION

I. Field of the Invention

The present invention relates to an electrical connector assembly for termination of coaxial cable enabling rapid attachment to and detachment from a PCB of a large number of signal leads while ensuring an acceptable level of controlled impedance from the coaxial cable to the PCB.

II. Description of the Prior Art

Requirements of backplane interconnections for electronic data processing and telecommunications applications require ever increasing densities of electrical leads to accommodate an ever larger number of signals within a given unit of space. At the same time, the space requirements are ever decreasing and this combination has the undesirable effect of increasing noise potential by reason of the increased density of the signal leads. At the same time, it is necessary to maintain a matched impedance from the signal wire, through the region of the interconnection, and into the printed circuit board (PCB) with which the signal leads are being terminated. Typical of the problem being faced, and solved, by the present invention is the ability to achieve a standard 50 ohm impedance level for a defined density of leads for which it was only previously possible to obtain a 37 ohm impedance for a lead density which was less dense by approximately 25 percent. All known existing small diameter coaxial contacts (for example, contacts having a diameter of 0.100 inches) use insulation material for the dielectric. This results in lower impedance value. In contrast, the present invention employs air as the dielectric thereby achieving a higher impedance in a smaller space.

SUMMARY OF THE INVENTION

The present invention was conceived and has now been reduced to practice to satisfy the more stringent connection requirements referred to above. Thus, a controlled impedance connector assembly is disclosed which includes a receptacle adapted for mounting on a printed circuit board (PCB) and for mating reception of a plug which carries terminal ends of a plurality of coaxial contacts. A honeycomb grounding block is mounted in the plug to engageably receive the outer conductor of each coaxial contact, the inner conductor of each coaxial contact being electrically coupled to a signal lead by a first contact member. Signal pin contacts within the receptacle and electrically coupled with the signal conductors of the PCB are electrically coupled with each inner sleeve of the coaxial contact when the plug is inserted into the receptacle. Likewise, ground pin contacts within the receptacle and electrically coupled with the ground conductors of the PCB have second and third spaced resilient contact members, respectively, engaging the grounding block at distances farther from and nearer to the PCB than the first contact members. Within each coaxial contact, air is a primary dielectric between the outer diameter of the inner sleeve and the inner diameter of the outer sleeve and the distance between the two is controlled to thereby maintain a substantially uniform impedance in the region of the connector matched to that of the coaxial cable and the PCB. The signal and ground pin contacts may be pre-assembled in a holding block for storage or shipping enabling ready assembly into the receptacle and easy insertion of a plurality of small pins into small holes in the PCB, simultaneously, by aligning the tips of the pins through funnel shaped holes in the receptacle. Alignment of the holes in the receptacles with those in the PCB is accomplished by means of positioning pegs molded in the receptacle. Thereafter, connection to the PCB is accomplished at the time the connector assembly is being installed. The plug is of a sturdy clam shell design, and reusable zipper-type tubing is used as a jacket to protectively enclose the coaxial cable in a bundle as they extend away from the plug.

In a typical application, the invention enables termination of seventy two coaxial cables in a defined area of three quarters inch by one and one half inches with 0.120 spacing between centers of adjoining contacts. By reason of the unique design of the invention, as a connection is made by the plug with its associated receptacle, the coaxial shield associated with each signal lead is placed at ground potential prior to electrical coupling of the signal lead. Additionally, when the plug is withdrawn or disconnected, from the receptacle, the coaxial shield remains grounded until after its associated signal pin has been disconnected from the circuit. This arrangement provides for electromagnetic shielding for each of the signal wires and thereby assures a low noise level in the circuit.

Furthermore, when the plug is fully inserted into its mating receptacle, the signal is protected from outside interferences up to within 0.100 inches of the PCB. The signal is surrounded by four ground posts as it passes through that 0.100 inch distance which serve to provide a continuing shielding of the signal.

The invention also eases the ability to assemble multiple leads in a cramped location. For example, in the typical assembly referred to above enabling termination of seventy two coaxial cables in a defined area of three quarters inch by one and one half inches, tails of 122 contact pins must be mounted in a receptacle so as to be aligned with a similar number of holes in the mating PCB for subsequent termination. Again, typically, the holes in the PCB have diameters generally in the range of 0.015 to 0.022 inches and the width of the tails is generally less than 0.022 inches. Notwithstanding these very small dimensions, the invention enables rapid and accurate assembly of the contact pins in the receptacle.

Another benefit of the invention resides in an improved solderless, one step, crimping operation by means of which each coaxial contact is terminated on an end of a coaxial cable lead. Specifically, the invention provides for crimping of the inner sleeve through openings in the outer sleeve of the contact while simultaneously crimping the outer sleeve.

Other and further feature, objects, advantages, and benefits of the invention will become apparent in the following description taken in conjunction with the following drawings. It is to be understood that the foregoing general description and the following detailed description are exemplary and explanatory but are not to be restrictive of the invention. The accompanying drawings, which are incorporated herein and constitute a part of this invention, illustrate one of the embodiments of the invention and, together with the description, serve to explain the principles of the invention in general terms. Like numerals refer to like parts throughout the disclosure.

BRIEF DESCRIPTION OF THE DRAWINGS

FIG. 10 is a detail perspective view of a bundle of leads typically used with the invention and provided with a removable outer protective covering.

DESCRIPTION OF THE PREFERRED EMBODIMENT

Figure 1:
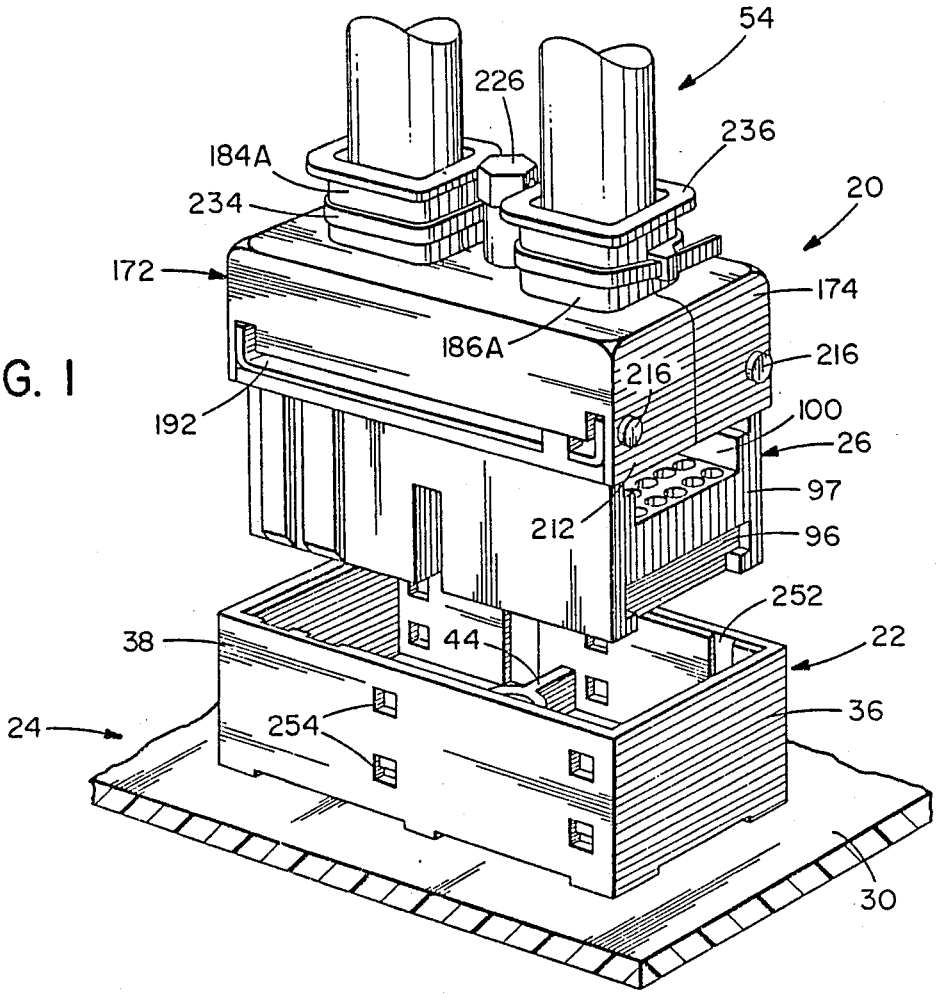
FIG. 1 is a partially exploded perspective view illustrating a controlled impedance connector assembly embodying the invention.
Figure 5:
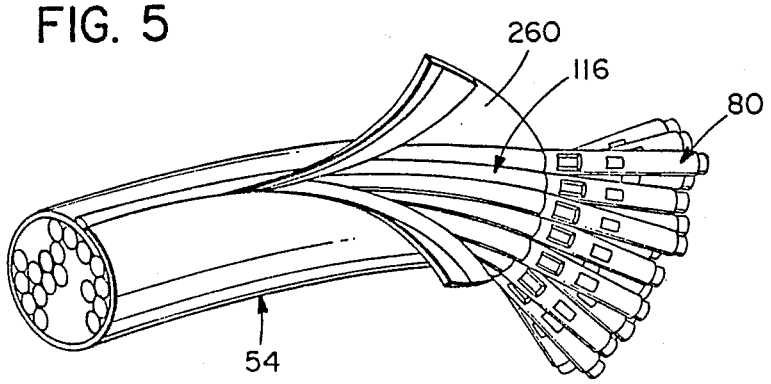
FIG. 5 is a cross section view taken generally along line 5—5 in FIG. 4 but including additional components not illustrated in FIG. 4.
Figures 2, 2A:
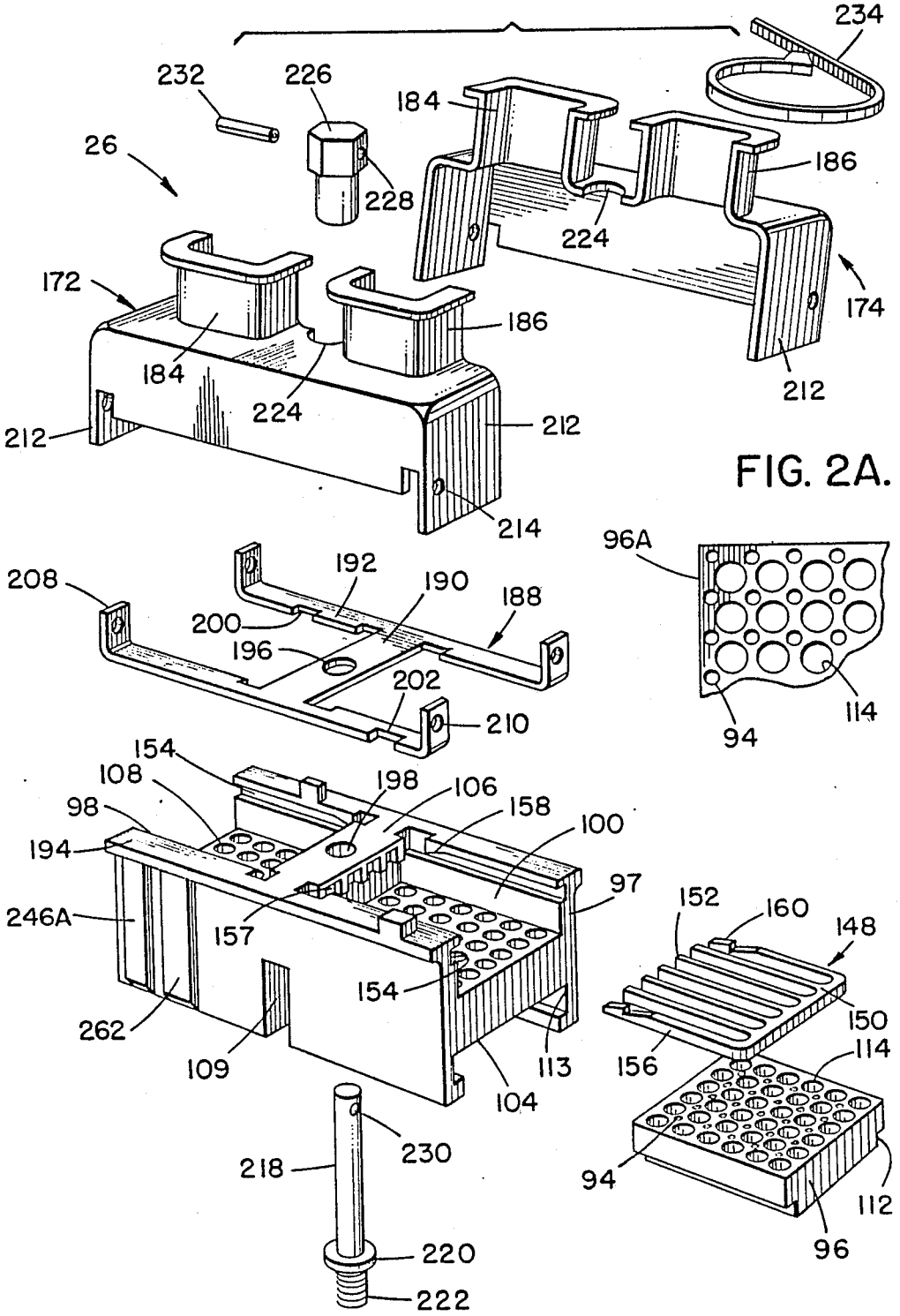
FIG. 2 is a further exploded perspective view of components illustrated in FIG. 1.
FIG. 2A is a detail partial top plan view, of a honeycomb grounding block utilized by the invention.
Figure 3:
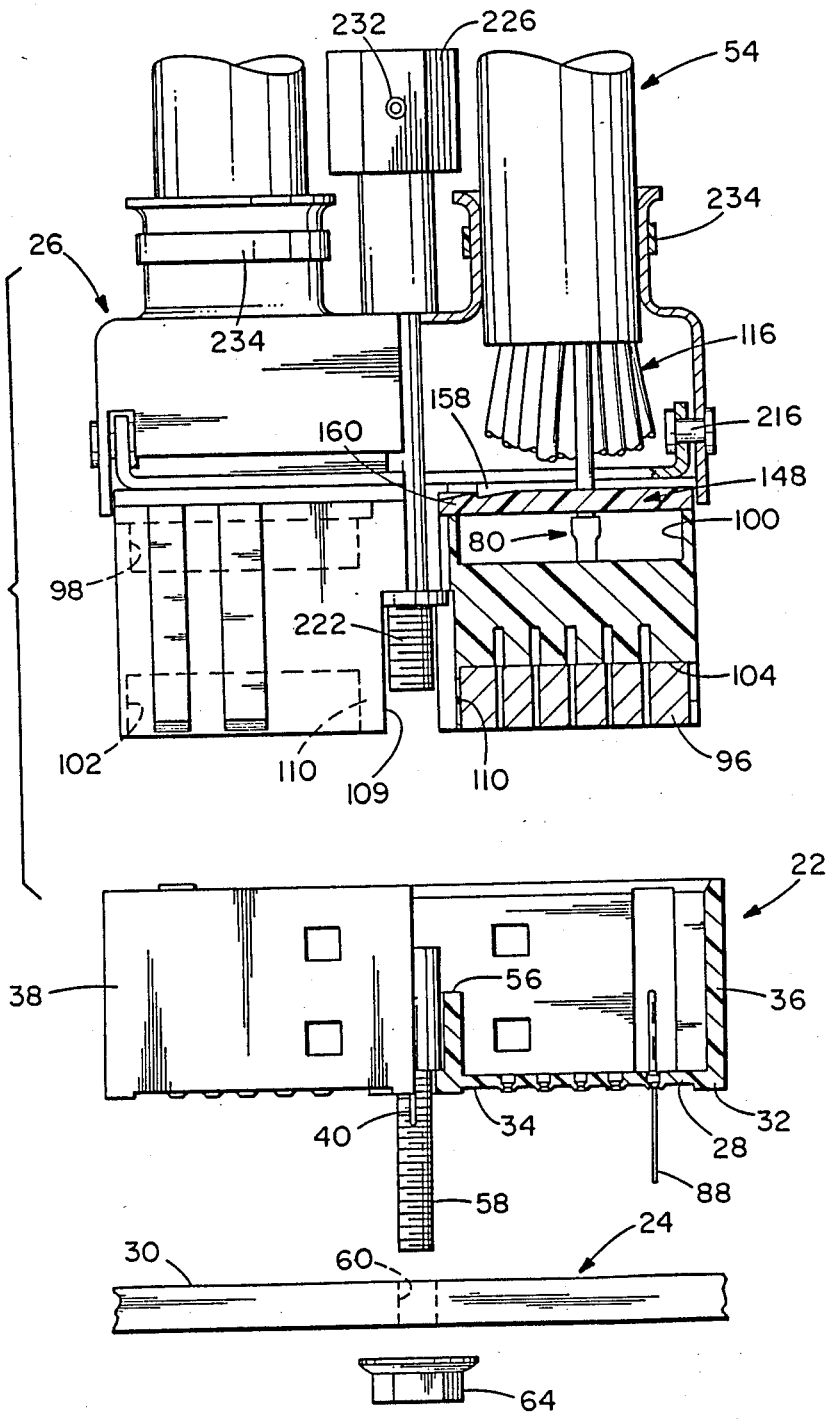
FIG. 3 is an exploded elevation view, certain parts being cut away and shown in section, to illustrate the plug utilized by the invention.
Figure 6:
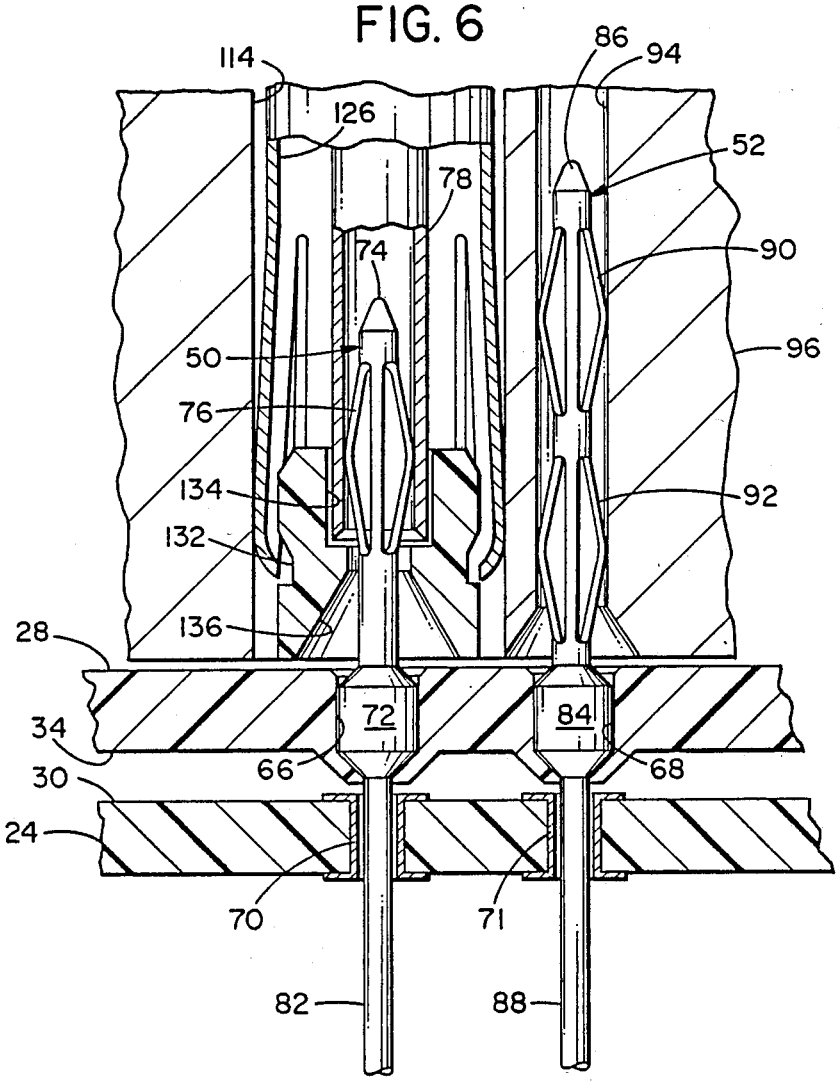
FIG. 6 is a detail elevation view, partly cut away and in section, illustrating the relationship between various components of the invention which would result in providing a maximum electromagnetic shielding for the signal wires of the connector assembly of the invention.

Turn now to the drawings and initially to FIGS. 1–6 which illustrate a controlled impedance connector assembly 20 embodying the invention. The connector assembly 20 includes a receptacle 22 composed of a suitable dielectric material adapted to be mounted on a printed circuit board (PCB) 24 and a plug 26 matingly engagable with the receptacle. As seen in FIGS. 3, 5, and 6, the receptacle 22 includes a planar base member 28 which lies generally parallel to and is proximately spaced from a planar surface 30 of the PCB 24. For reasons which will be explained subsequently, the base member 28 is of minimal thickness and standoff members 32 (FIGS. 1 and 3) which extend away from the base member 28 have extreme bearing surfaces engagable with the surface 30. This construction defines a recess 34 which serves to accommodate metallization which is present on the surface 30. It also allows for efficient cleaning operations to be performed should they be needed to flush out entrapped flux residue which may result from a typical wave soldering process.

The receptacle 22 includes a continuous wall which is integral with and upstanding from the base member 28 and extends around the periphery of the base member. The wall is in fact a pair of opposed end walls 36 lying in substantially parallel planes and a pair of integral opposed sidewalls 38 which also lie in substantially parallel planes, the end walls 36 being perpendicular to the sidewalls 38. At least a pair of positioning pegs 40 extend transversely of the base member 28 as seen particularly well in FIGS. 3 and 5. The pegs 40 may actually extend from the standoff members 32 and are intended for mutual reception with matching holes 42 provided in the PCB 24. The pegs 40 and the holes 42 serve to assure the proper alignment of the receptacle 22 on the PCB 24 for purposes which will be clear as the description continues.

Figure 8:
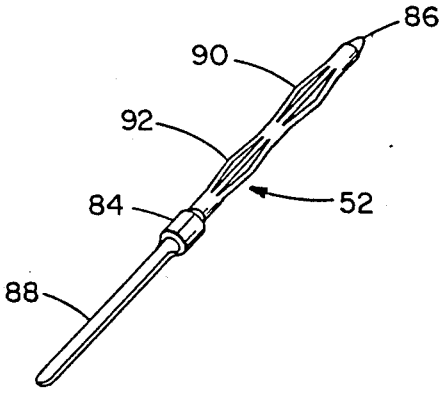
FIG. 8 is a perspective view of a ground pin contact utilized with the invention.
Figure 7:
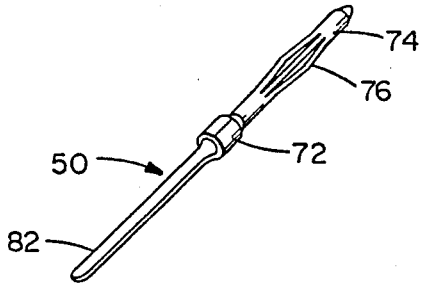
FIG. 7 is a perspective view of a signal pin contact utilized with the invention.

A partition 44 is upstanding from the base member 28 and extends between the sidewalls 38 which are positioned generally parallel to and intermediate the end walls 36. Together, the end walls 36, the side walls 38, and the partition 44 define a pair of side by side compartments 46 and 48 (see especially FIG. 4). Each of the compartments 46, 48, as illustrated, is capable of accommodating 36 signal pin contacts 50 (FIG. 7) and 25 associated ground pin contacts 52 (FIG. 8) comprising a total bundle of leads 54 which approaches the largest number of leads which experience to date has found to be desirable for purposes of handling as a group. By utilizing a single connector assembly which readily accepts two such bundles 54, a more compact assemblage of leads is thereby achieved than has been possible heretofore.

Figure 9:
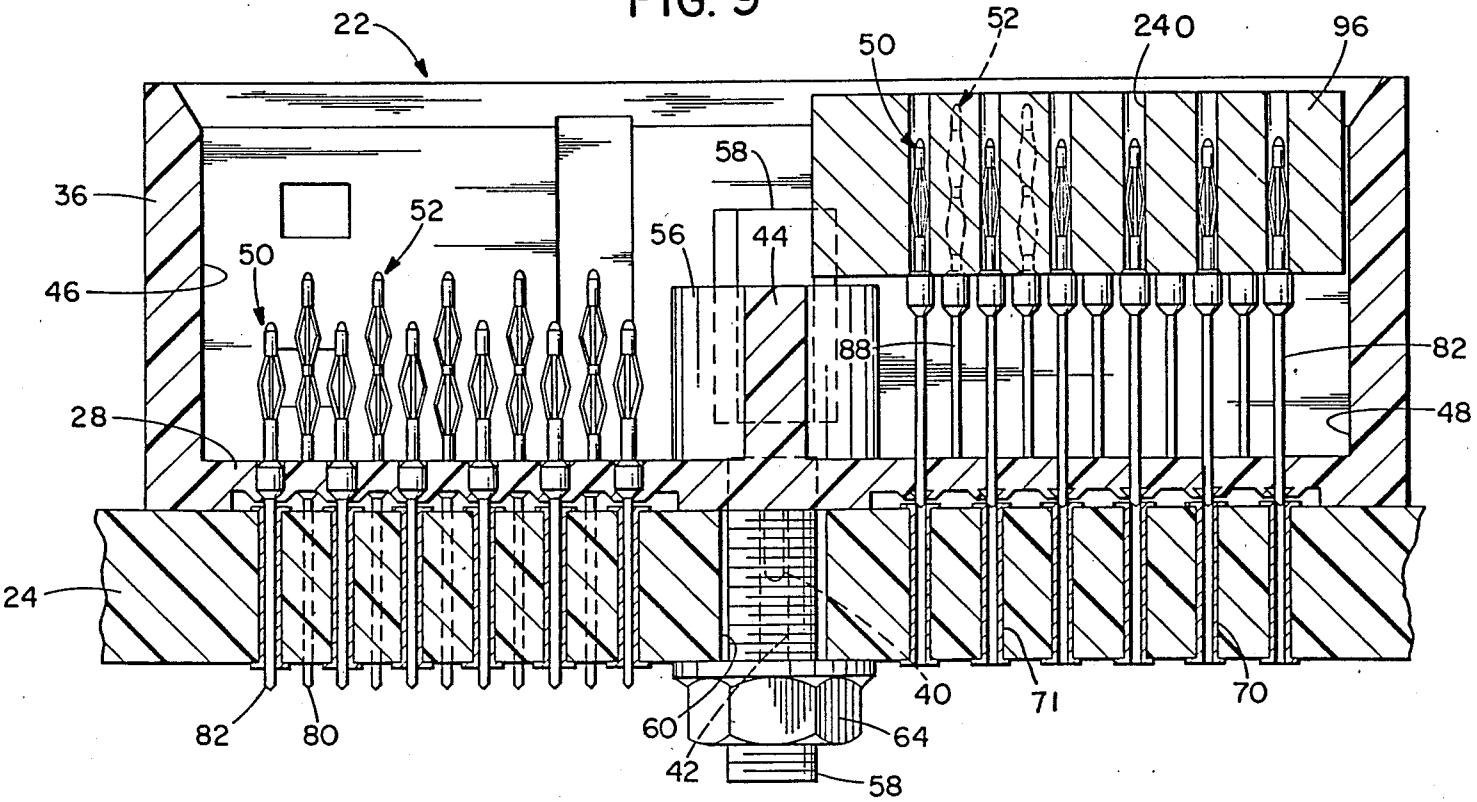
FIG. 9 is an elevation view, partly cut away and in section, illustrating the manner of assembling and mounting pin contacts to the receptacle and to the PCB illustrated in FIG. 1 and illustrating, respectively, initial and final positions of the pin contacts during the assembly procedure.

A boss 56 formed integral with the partition 44 intermediate the sidewalls 38 has a clearance hole therein which serves to receive therethrough a jacksocket body 58 (FIGS. 3 and 9). With the receptacle 22 mounted on the PCB 24 in a proper manner as illustrated in FIG. 1, the jacksocket body 58 extends through a mating clearance hole 60 (FIGS. 3 and 9) a sufficient distance to receive an associated nut 64. Thus is assured the firm, but releasable, mounting of the receptacle 22 onto the PCB 24. A noteworthy benefit of this construction resides in the fact that the screw 58 is utilized for fastening two bundles 54 which results in further conservation of space.

The base member 28 is formed with a plurality of first and second laterally spaced mounting holes 66, 68, respectively, as most clearly seen in FIGS. 5 and 6. In a manner which will be more thoroughly explained below, the mounting holes 66 serve to fittingly receive the pin contacts 50 and the mounting holes 68 serve to fittingly receive the pin contacts 52. As seen in FIG. 6, the PCB 24, in customary fashion, has a plurality of metallized through holes 70, 71, respectively associated with each of the mounting holes 66, 68.

It was previously explained that each mounting hole 66 serves to fittingly receive a signal pin contact 50. Each signal pin contact 50 is elongated and has a centrally positioned barrel portion 72 which is fittingly received in its associated mounting hole 66. Additionally, each signal pin contact 50 has a nose 74 formed with a resilient contact member 76 which, as illustrated, is of a "live" four tine construction. The contact member 76 is engageable, in a manner to be described, with an associated one of the inner sleeves 78 of a coaxial terminal 80. The four tine construction provides optimal contact force and redundancy while at the same time keeping mating forces low as is necessary in a multi-contact connector assembly. The signal pin contact 50 extends between the nose 74 and a tail end 82 which is engageable with its associated through hole 70 in the PCB 24. When the connector assembly 20 is complete, the tail 82 is electrically coupled to the circuitry in the PCB 24 by means of a wave soldering operation.

It was also previously explained that each mounting hole 68 serves to fittingly receive a ground pin contact 52. Each ground pin contact 52 is elongated in a manner similar to each signal pin contact 50 and formed with an intermediate barrel portion 84 which is fittingly engageable with the mounting hole 68. Each ground pin contact 52 also extends between a nose end 86 and a tail end 88. Proximate to the nose end 86 are a pair of longitudinally spaced resilient contact members 90 and 92, respectively, which are engageable with an associated socket 94 in a suitable grounding block 96. As in the instance of the contact member 76, each of the contact members 90, 92 are of a "live" four tine construction. Again, as with the construction of the signal pin contact 50, the tail end 88 of the ground pin contact 52 is engageable with and electrically coupled to an associated through hole 71, the through hole in this instance being coupled to ground potential. In this manner, each of the contact members 92 is coupled to ground potential.

Figure 4:
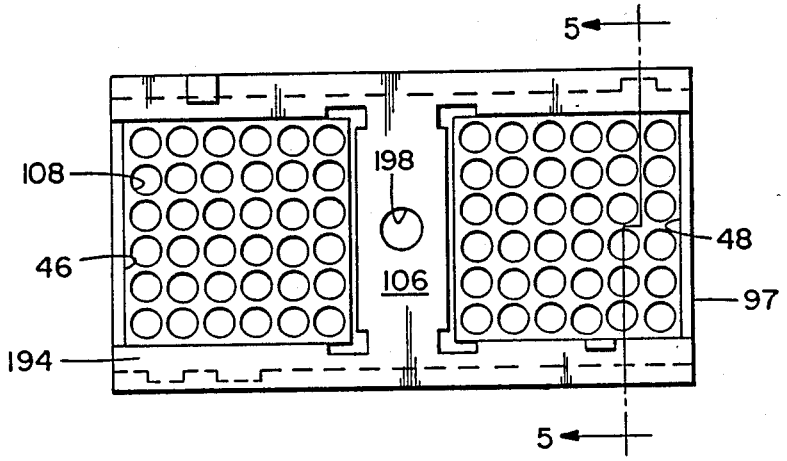
FIG. 4 is a top plan view of one of the components illustrated in FIG. 2.
Figure 5:
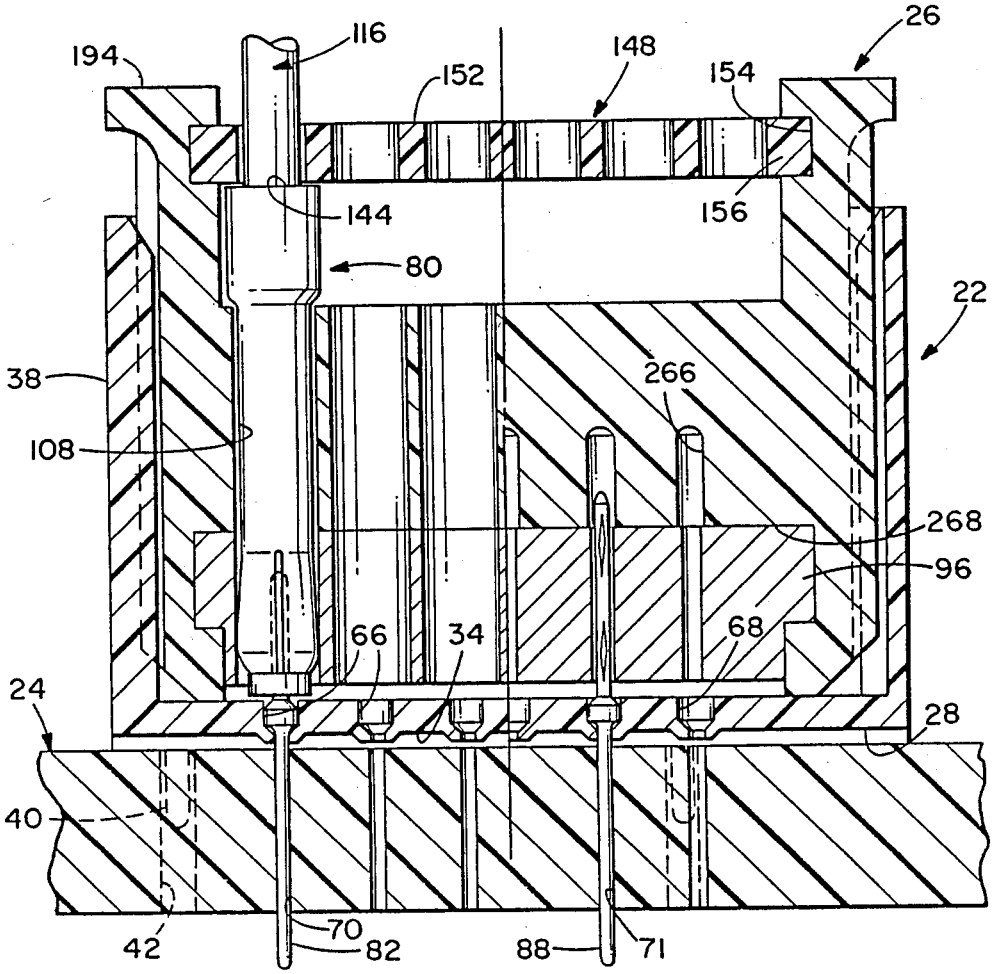

The plug 26 will now be described with particular reference to FIGS. 1, 2, and 3. The plug which is matingly engageable with the receptacle 22 has a dielectric housing 97 including a pair of opposed aft recesses 98 and 100 lying in a common plane, and a pair of opposed forward chambers 102, 104 also lying in a common plane and parallel to, but spaced from, the plane of the recesses 98, 100. A transverse partition 106 separates the recesses 98, 100. Also as seen in FIG. 2, the housing 96 is formed with a plurality of bores extending generally in a fore and aft direction for receiving coaxial terminals 80 in a manner to be described. In the embodiment illustrated, there are a total of 36 such bores 108 which extend between each upper recess 98 and its associated lower chamber 102 and between each upper recess 100 and its associated lower chamber 104. Also as seen in FIGS. 2 and 4, a lower slot 109 is generally coplanar with the partition 106 and defines a pair of parallel spaced short walls 110 (FIG. 4) which help to enclose the chambers 102, 104. The slot 109 matingly receives the partition 44 of the receptacle 22 when the plug 26 is proximately engaged with the receptacle.

The grounding block 96, previously mentioned and composed of highly conductive metal, metallic coated plastic, or other suitable conductive material, is slidably received in each of the chambers 102, 104 proximate to the front end of the plug 26. Each grounding block is held firmly in position within each of its associated chambers 102, 104 in any suitable fashion. According to one manner of attachment which is illustrated, each grounding block is provided with a pair of opposed elongated cutouts 112 which matingly engage with a similar pair of opposed elongated grooves 113 formed in the chambers 102, 104 within the housing 97. The grounding blocks 96 are thereby held in a substantially rigid manner against fore and aft movement relative to the housing 97.

As particularly well seen in FIG. 2, each grounding block 96 is formed with a plurality of first sockets 114 and second sockets 94, previously referred to, which extend transversely therethrough. In the particular embodiment illustrated, each grounding block 96 has a total of 36 first sockets 114 associated with the bores 108 in the housing 97 and 25 second sockets 94 so positioned that a row of the sockets 94 is interposed between each row of the sockets 114. Another way of describing the relative relationship between the sockets 94 and 114 is that they are positioned generally mutually concentrically with increasing distance from the center of the grounding block 96 toward its outer periphery. It was previously explained that the second sockets 94 serve to engageably receive the ground pin contacts 52. It is now pointed out that each of the sockets 114 serves to similarly engageably receive a coaxial terminal 80 as is most clearly seen in FIGS. 5 and 6. FIG. 2A illustrates a slightly modified grounding block 96A in which the second sockets 94 not only surround the inboard first sockets 114, but also the outermost row of sockets 114 to thereby achieve a maximum shielding of the signal leads which are to be received within the sockets 114.

In regard to a continuing description of the plug 26, the coaxial terminals 80 with which it is associated will now be described. Viewing FIGS. 3, 5, 6, and 9–13, each coaxial terminal 80 serves to terminate an individual coaxial cable lead 116 having an inner signal carrying wire 118, an outer conductive shield 120, a dielectric layer 122 intermediate the inner wire and the outer shield, and an outermost dielectric covering 124 (see especially FIGS. 11, 12, 12A, and 12B).

The terminal 80 itself comprises an elongated tubular electrically conductive outer sleeve 126 which is fixed to the outer conductive shield 120 in a manner to be described. An inner electrically conductive sleeve 78, previously mentioned, is coaxial and generally longitudinally coextensive of the outer sleeve 126. The signal carrying wire 118 extends into the inner sleeve 78 and the two are joined together in a manner to be described. Fore and aft bushings 128, 130 of dielectric material may be of similar construction, but oppositely disposed, at longitudinally spaced locations along the terminal 80. Bushings 128, 130 mutually support the outer sleeve 126 and the inner sleeve 78 to hold them fixed relative to one another both longitudinally and radially or laterally.

It is to be noted that it is desired to shield each signal carrying wire 118 from its adjoining signal carrying wires. It is also desired to control the impedance through the coaxial inner and outer sleeve assembly to closely match the impedance of the coaxial cable. By reason of this construction, the exposed wire 118 and its associated sleeve 78 are surrounded by air, an ideal insulating medium. Air is used to provide a low dielectric constant (namely, one) so that a 50 ohm impedance level can be maintained in a smaller diameter outer body. The outer diameter of the outer sleeve 126 may typically be 0.087 inches, although that dimension should not be restrictive of the invention. This construction assures that the terminal 80 possesses the strength necessary to perform its intended function of selectively coupling its associated lead 116 to desired circuitry or uncoupling it from the circuitry while the impedance manifested by the coaxial terminal 80 is substantially matched to that of the coaxial cable lead 116 and to such circuitry to which it might be coupled.

Figure 12:
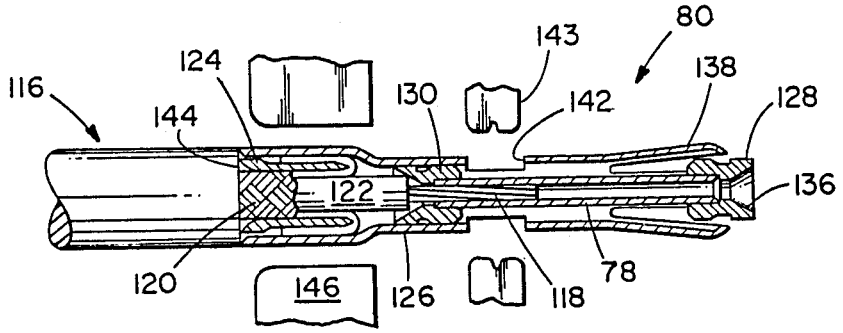
FIG. 12 is a side elevation view, partly cut away and in section, illustrating a coaxial terminal mounted on a coaxial cable lead.
Figure 12B:
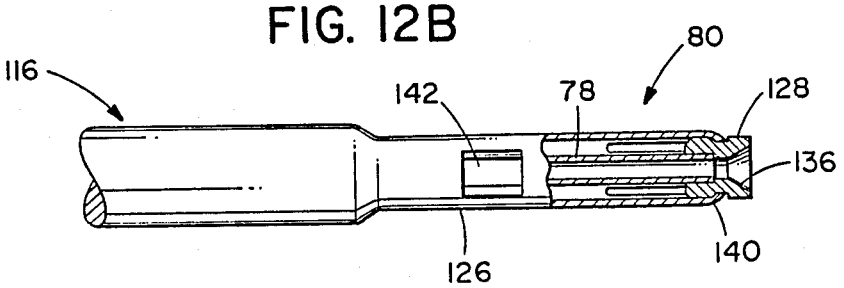
FIG. 12B is a side elevation view, similar to FIG. 12 with the coaxial terminal lead rotated 90° about its longitudinal axis from the position illustrated in FIG. 12.
Figure 12A:
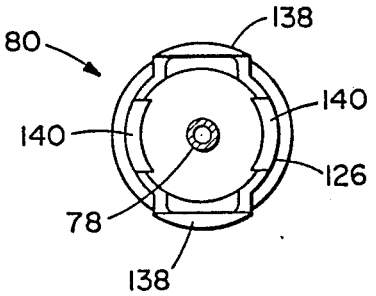
FIG. 12A is an end elevation view of the coaxial terminal illustrated in FIG. 12, a part having been eliminated for clarity.

As seen most clearly in FIGS. 6, 12 and 12B, each bushing 128, 130 has a generally cylindrical outer surface, an outer diameter substantially the same as the inner diameter of the outer sleeve 126, and an annular groove 132 formed in its outer surface. Each bushing also has a longitudinal bore 134 adapted to slidably receive an end of the inner sleeve 78 and a funnel shaped entrance 136 generally coaxial and in communication with the longitudinal bore 134 to lead into the interior of the inner sleeve. Four longitudinally extending slots 137 formed at a forward end of the outer sleeve 126 define two pairs of diametrically opposed fingers, 138 and 140, respectively. The tip ends of the fingers 138 are turned inwardly so as to snap into gripping engagement with the groove 132. The fingers 140 are bowed outwardly so as to tightly engage the inner surface of the socket 114. Thus, the fingers 140 are forced to deflect as each coaxial terminal 80 is inserted into a mating first socket 114. That deflection causes forces to be generated against the inner walls of the socket thereby establishing the required firm engagement necessary while also assuring ease of insertion and withdrawal of the terminal 80, whenever desired.

Figure 11:
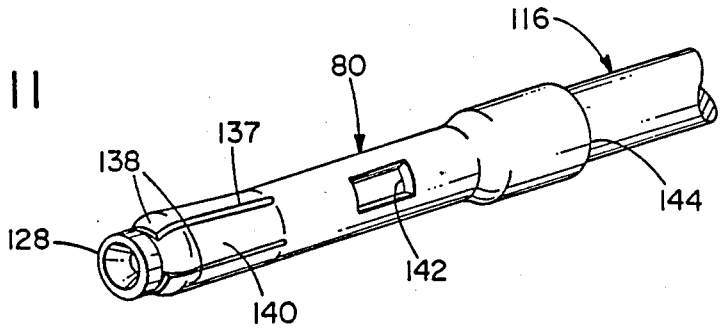
FIG. 11 is a detail elevation view in section illustrating in enlarged form a part of the construction illustrated in FIG. 5.

As seen in FIGS. 11, 12, and 12B, the outer sleeve 126 has a pair of diametrically opposed windows 142 positioned longitudinally intermediate the bushings 128, 130. The windows enable reception therethrough of radially directed indenting dies 143 which are intended to crimp the inner sleeve 78 into fixed engagement with the signal carrying wire 118. At locations spaced forwardly from an aft end 144 of the outer sleeve 126 (see FIGS. 11 and 12B), the outer sleeve is crimped into fixed engagement with the outer conductive shield 120 as by opposed indenting dies 146 (see FIG. 12). There may, for example, be four such indenting dies 146 positioned at equally spaced circumferential locations around the outer surface of the sleeve 126.

For a continuation of the description of the plug 26, turn now to FIGS. 2, 3, and 5. When a plurality of coaxial terminals 80 have been inserted into the bores 108 of the housing 97, one such terminal being illustrated in FIG. 3, a gate 148 is slidably received into each of the recesses 98, 100 to prevent undesired withdrawal of the terminals from the housing. The gate 148 includes a transverse bight portion 150 and a plurality of picket members 152 integral with and extending perpendicularly from the bight portion 150. Each of the recesses 98, 100, is formed with opposed tracks 154 to slidingly receive and guide outermost picket members 156. Opposed faces of the partition 106 are apertured to receive the extreme ends of the picket members 152 and mutual camming and locking members 158, 160, on the housing 97 and at the ends of the picket members 156, respectively, serve to lock the gate member 148 onto the housing 97 when it reaches its innermost position, that is, its position nearest the partition 106.

As seen most clearly in FIG. 5, the spacing between adjoining picket members 152 and 156 is sufficient to freely receive coaxial cable leads 116 therethrough. However, the diameter of the coaxial terminals 80 is substantially larger such that their aft ends would engage the picket members 152, 156 in the event there is any urging to draw them out of their associated bores 108 in the housing 97. While the members 158, 160 cooperate to retain the gate member 148 in position overlying the bores 108 and any terminals 80 received therein, it will be appreciated that the picket members 156 are sufficiently flexible that, whenever desired, the members 160 can be suitably disengaged from the members 158 to allow the gate member 148 to be withdrawn from the housing 97.

Thus, the gate member 148 serves two functions: first, to lock the coaxial terminals into the housing 97; and second, to assure that the coaxial terminals are all fully inserted into position into the housing. If indeed any coaxial terminal is not fully inserted, the gate member will not be insertable to its final position in the housing 97, thereby signaling the assembler of the necessity to check each of the terminals 80.

Continuing with the discussion of the plug 26, and referring now most particularly to FIGS. 1, 2, and 3, a pair of opposed mating clam shell covers 172, 174 overlie and enclose the rear end of the housing 97. Each cover 172, 174 also includes a pair of half collars 184, 186, respectively, which mate to form full collars when the covers are closed. Each full collar 184A, 186A, as illustrated in FIG. 1, defines an outlet for a bundle 54 of coaxial cable leads 116 as they extend from the coaxial terminals 80 for termination at a distant location.

An H-shaped bracket member 188 is used to attach the clam shell covers 172, 174 to the housing 97. To this end, it includes a bight element 190 which overlies the partition 106 and a pair of spaced apart, parallel legs 192 which overlie and are supported on upper surfaces 194 of the housing 97 coplanar with the upper surface of the partition 106. The bight element 190 has a centrally disposed hole 196 which overlies a bore 198 in the partition 196. Suitable cutouts 200 and 202 are formed in the legs 192 in order to accommodate standoffs 204 and 206 extending beyond the upper surfaces 194.

The opposed ends of the legs 192 are upturned to define feet 208, each formed with a mounting hole 210 therein. Opposed end flanges 212 on each of the covers 172, 174 is provided with a mounting hole 214. With the covers 172, 174 positioned over the aft end of the housing 97 with the bracket member 188 positioned thereon, the mounting holes 214 in the end flanges 212 ar aligned with the mounting holes 210 in the feet 208 enabling rivets 216 or other suitable fasteners to be inserted and fastened thereto (see FIG. 3). A jack screw post 218 has a smooth upper end which is freely received through the bore 198 as far as permitted by an intermediate annular flange 220, then followed by a lower threaded stem 222 which, as will be seen below, is threadedly engageable with the jacksocket body 58.

With the covers 172, 174, positioned over the aft end of the housing 97 and mounted on the bracket member 188, then swung to their closed position as illustrated in FIG. 1, the free end of the jack screw post 218 extends rearwardly through the bore 198, the hole 196 and through the semi-circular cutouts 224 formed in the covers 172, 174. Thereupon, an internally bored jack handle 226 extends through the cutouts 224, and the hole 196 into the bore 198 and over the upper end of the jack screw post 218 until a diametrically extending aperture 228 is positioned so as to be aligned with a similar aperture 230 in the upper end of the post 218. A roll pin 232 is fittingly received through the apertures 228, 230 and serves to join the two parts together. When this has been accomplished, securing straps 234 are receivable around each collar 184A and 186A and drawable into contiguous relationship therewith to thereby hold the covers 172, 174 in their closed positions. Annular flanges 236 provided at the extremities of the collars 184A, 186A serve to prevent inadvertent removal of the straps 234 from the ends of the collars.

With reference now to FIGS. 9, and 13–15, a holding block 238 is illustrated which may be of any suitable material having a plurality of through bores 240 therein with the same arrangement or design as the bores 66 and 68 in the base member 28 of the receptacle 22. The bores 240 receive the nose ends of the pin contacts 50 and 52 in the same relationship that they are to assume when they are inserted into the mounting holes 66 and 68 in the base member 28. Thus, all of the bores 240 receive an associated pin contact 50 or 52 and, in each instance, the associated barrel portions 72 and 84 engage an undersurface 242 of the holding block.

Figure 13:
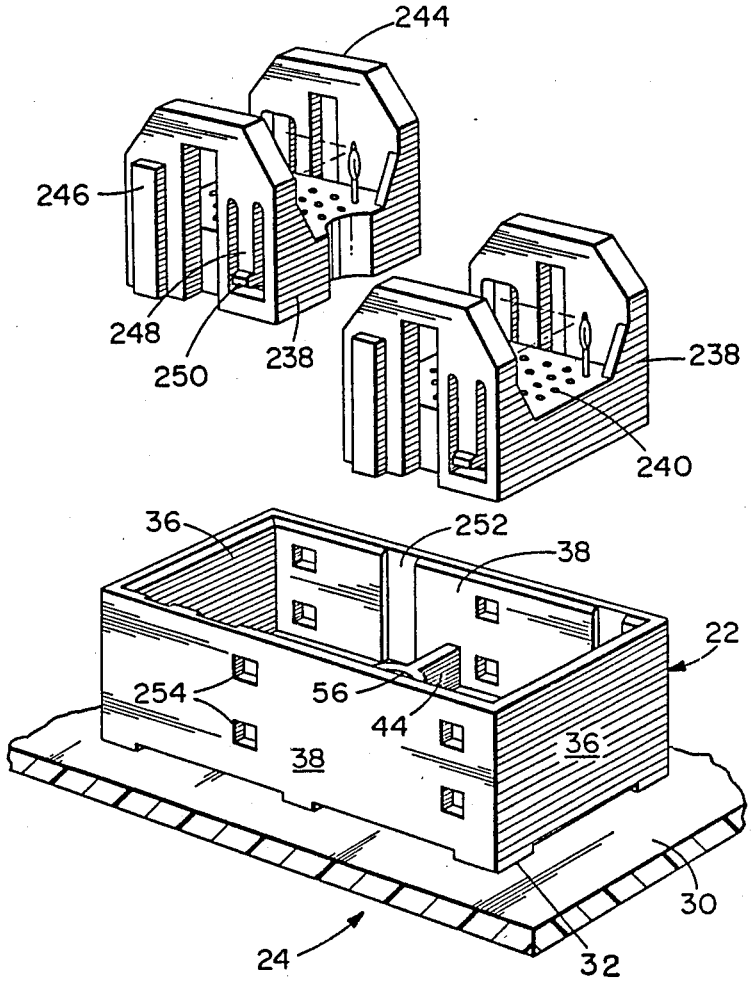
FIG. 13 is an exploded perspective view illustrating a PCB mounted receptacle with a pair of holding blocks positioned for mating reception therewith.

As seen in FIG. 13, actually two holding blocks 238 are employed with each receptacle 22. That is, a holding block 238 is intended for temporary insertion into each of the opposed end cavities within the receptacle separated by the partition 44. At laterally disposed ends of each holding block 238, there is provided a handle member 244, a guide key 246, and a resilient locking finger 248 with a locking tab 250 at its extreme end. The inner surfaces of the sidewalls 38 are formed with guide slots 252 to slidably receive the guide keys 246. Additionally, windows 254 are provided in the sidewalls 38 at two different elevations adapted to receive the locking tabs 250 therein.

Figure 16:
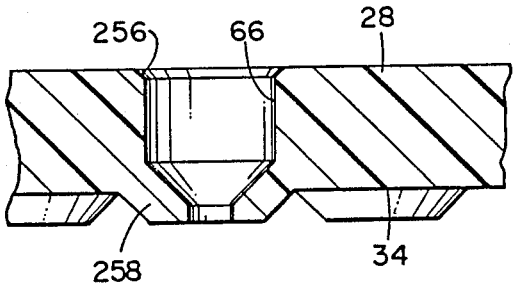
Figure 14:
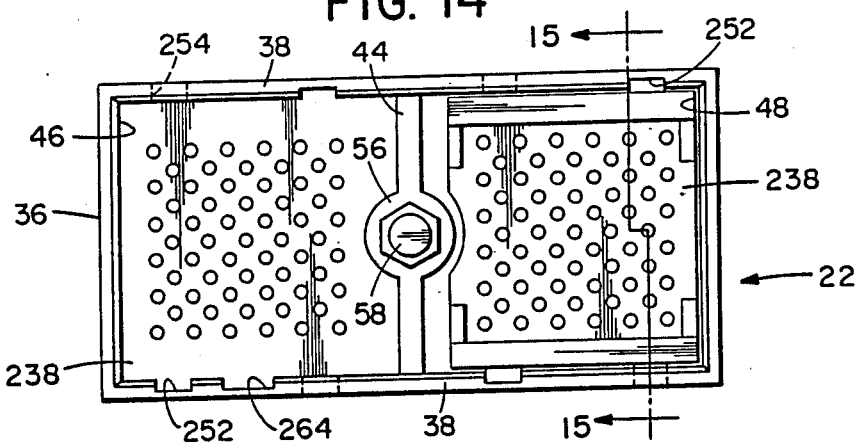
FIG. 14 is a top plan view of a receptacle of the invention with one holding block in mating reception therewith.
Figure 15:
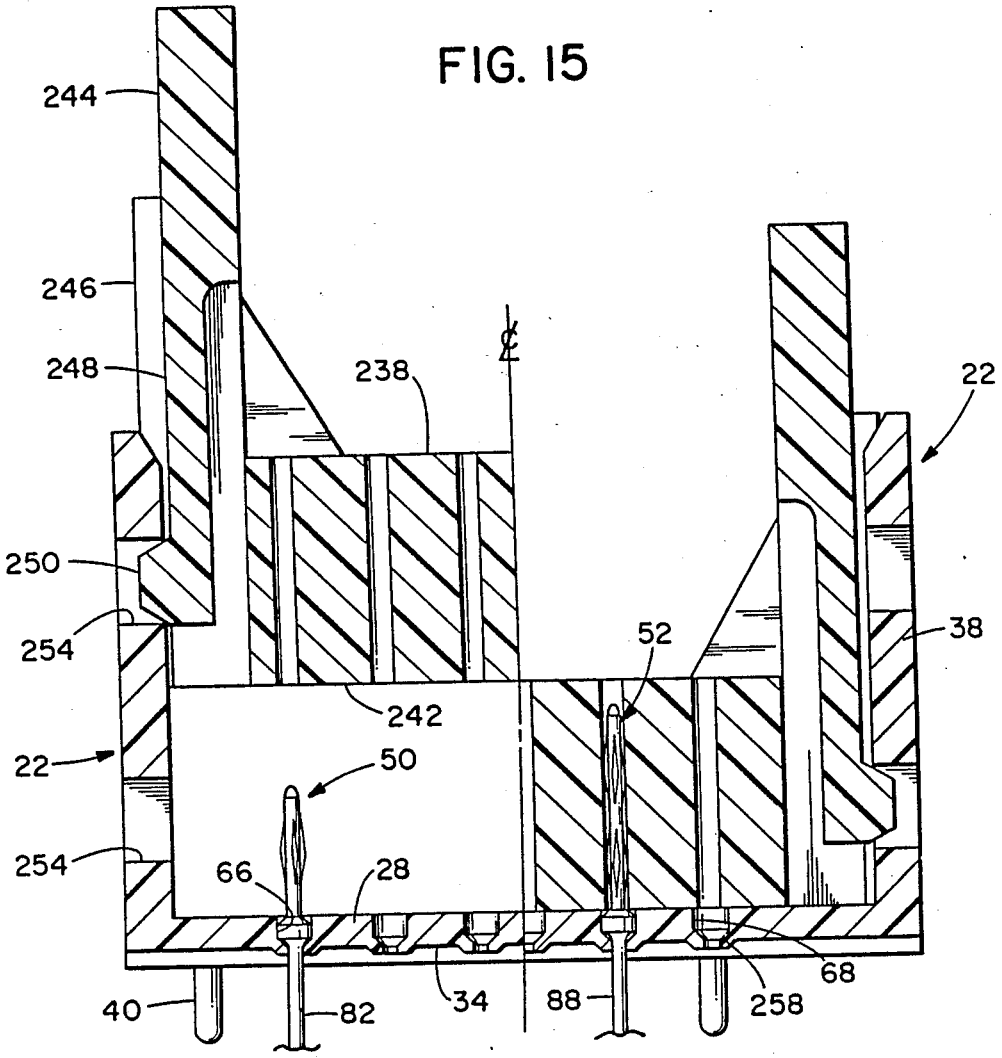
FIG. 15 is a cross section view taken generally along line 15—15 of FIG. 14 but illustrating another holding block in the holding position thereon; an FIG. 16 is a detail cross section view of a part illustrated in FIG. 6.

The holding block 238, with the pin contacts 50 and 52 mounted thereon, is then moved into its associated compartment within the receptacle 22 until the tips of the tails 82 of the pin contacts 50 are received in and extend through their associated mounting holes 66. A chamfered rim 256 (see FIG. 16) serves to guide the barrel portions of each pin contact 50, 52 into its associated mounting hole 66, 68, respectively, in the event it is somewhat skewed. The same situation exists with respect to the tips of the tail ends 82 of the pin contacts 52 and their associated mounting holes 68. In either case, it may be desirable for the mounting holes 66 and 68 not to be through holes, but to require the tips of the tail ends 82 and 88 to punch through a thin remaining membrane at the bottom of each to aid in centering and holding the tail ends properly positioned relative to the base member 28. At the very least, a necked down cone of material 258 with a reduced opening therethrough for fitting reception of the tails 82, 88 is provided for this purpose.

It may be desirable for a manufacturer to assemble the components in the manner illustrated at the right hand side of FIG. 9 but without the receptacle 22 being mounted on the PCB 24. In that event, it would be up to the user to install the pin contacts 50 and 52 to the PCB at a later time of his choosing. The mutual construction of the holding block 238 and receptacle 22 just described is used to accommodate this goal. Specifically, when all of the pin contacts have been mounted in the holding block 238 with their nose ends 74 and 86, respectively, received in the through bores 240 and with their barrel portions 72, 84, respectively, butted against the undersurface 242, the holding block is moved toward and into engagement with the receptacle 22 such that the guide keys 246 on each handle member 244 is slidably engaged with its associated guide slot 252 of the receptacle. The locking tabs 250 at the ends of the locking fingers 248 are first cammed inwardly by the sidewall 38, then spring outwardly into engagement with its associated upper tier window 254. With the holding block 238 in this position, the extreme tips of the tail ends 82, 88 are firmly held by their associated cones of material 258. The mutual engagement of the tabs 250 and their associated windows 254 serves to maintain the relative positioning of the holding block 238 and the receptacle 22 until a further operation is desired.

Subsequently, when it comes time to install the pin contacts 50, 52, into the PCB 24, pressure on the holding block in the direction of the base member 28 causes the tabs 250 to be cammed out of engagement with the upper tier of windows 254. The holding block 238 with its cargo of pin contacts 50, 52 is then moved toward the base member 28. With the receptacle 22 mounted on the PCB 24 as illustrated in FIGS. 9, the tail ends 82 and 88 are caused to pass through the metallized holes 70 and 71, respectively, until they achieve the finally disposed relative positions illustrated at the left hand side of FIG. 9. With the tips of the tail ends 82 and 88 protruding through the underside of the PCB 24, the PCB can be subjected to a wave of solder in a known manner to mechanically and electrically couple the pin contacts to their associated circuitry on the PCB 24. Thereupon, the holding blocks 238 are withdrawn from the receptacle 22 and discarded, or set aside for future use.

Thereupon, as seen in FIGS. 3 and 6, the receptacle is fixedly mounted onto the PCB 24 by means of the jacksocket body 58 and mutually threaded nut 64. Then, with the receptacle 22 thus firmly secured to the PCB 24, the plug 26 is advanced toward mating engagement with receptacle 22 such that guide keys 246A and 262 formed on the housing 97 will slidingly engage with guide slots 252 and 264 to thereby assure proper engagement therebetween. Thereupon, by turning the jack handle 226 the threaded stem 222 of the jack screw post 218 is threadedly engaged with the upper end of the jacksocket body 58 and continues to be turned until the plug 26 is firmly, fixedly mounted into the receptacle 22. When this occurs, all of the pin contacts 50 are mechanically and electrically engaged with the inner sleeves 78 of their associated coaxial terminals 80 and the ground pin contacts 52 are mechanically and electrically connected to their associated second sockets 94 in the grounding block 96. Since the ground pin contacts 52 are longer than the signal pin contacts 50, complementary bores 266 are formed into a foreside 268 of the housing 97 (see especially FIG. 5) to accommodate the additional length. The connector assembly 20 is now in a condition to transmit electrical signals.

It is desirable to provide an outer protective covering 260 for each bundle of leads 54. While shrink tubing could be used, it is difficult and time consuming to thread a large number of leads through such tubing. Furthermore, the original shrink tubing would have to be cut off and removed, then all of the leads uncoupled and inserted into new shrink tubing each time it is necessary to work on or replace an individual lead. Accordingly, suitable zipper-type tubing of the type generally illustrated in FIG. 10 is preferred since it can be applied and then unzipped, and reused as many times as necessary without affecting those leads which are not of concern.

Although there are numerous benefits which flow from the invention, a primary benefit resides in the construction according to which a high density of contacts can be joined in one step to a receiving PCB while assuring that impedances are matched between each incoming lead, its connection, and the circuit board. As the plug 26 moves toward engagement with its mating receptacle 22, the contact members 92 of the ground pin contacts 52 first move into engagement with the grounding block 96 to initially discharge any static electricity which may be present. Thereupon, the contact members 76 of the signal pin contacts 50 engage their associated inner sleeves 78 of the coaxial terminals 80. When the plug 26 reaches its final position within the receptacle 22, the contact members 92 engage the grounding block 86 at a region which is nearer the PCB 24 than the location of engagement between the contact members 76 and their associated inner sleeves 78. This construction minimizes the possibility of ground loops which can be destructive to the circuitry.

By reason of the design which is best illustrated in FIG. 6 of the relative positioning of the contact members 90, 92 and 76, the thin construction of the base member 28, together with the use of air as the dielectric in the coaxial terminal 80 and the positioning as best illustrated in FIG. 2A of surrounding each signal pin contact 50 with four ground pin contacts 52, all of these features result in maximum electromagnetic shielding for each of the signal wires, assuring a controlled minimal impedance, and a low noise level in my line which may be in close proximity to any number of "active" lines.

While a preferred embodiment of the invention has been disclosed in detail, it should be understood by those skilled in the art that various modifications may be made to the illustrated embodiments without departing from the scope as described in the specification and defined in the appended claims.

What is claimed is:

1. A controlled impedance connector assembly comprising:

a receptacle of dielectric material adapted to be mounted on a printed circuit board having a plurality of metallized through holes therein, said receptacle including a planar base member lying generally parallel to and proximately spaced from a planar surface of the printed circuit board, said base member having a plurality of first and second laterally spaced mounting holes extending transversely therethrough;

a plug matingly engageable with said receptacle including a dielectric housing, electrically conductive grounding block means mounted in said housing having a plurality of first and second sockets extending transversely therethrough, and a plurality of coaxial terminals, each having an outer conductive sleeve permanently coupled to the outer braided shield of a coaxial cable lead and mechanically and electrically engageable with an associated one of the first sockets and an inner conductive sleeve electrically coupled to a signal wire;

a plurality of elongated signal pin contacts, each being fittingly received in an associated one of the first mounting holes in said base member and extending between a nose end and a tail end, said nose end having a first resilient contact member engageable with an associated one of said inner sleeves of said coaxial terminals at a first predetermined distance away from the printed circuit board, said tail end of each of said signal pin contacts being engageable with an associated through hole in the printed circuit board and electrically coupled thereto;

a plurality of elongated ground pin contacts, each being fittingly received in an associated one of the second mounting holes and extending between a nose end and a tail end, said nose end of each of said ground pin contacts having second and third longitudinally spaced resilient contact members engageable with an associated one of the second sockets of said grounding block, each of said second contact members being engaged with its associated second socket at a second predetermined distance away from the printed circuit board which is greater than the first predetermined distance, each of said third contact members being engaged with its associated second socket at a third predetermined distance away from the printed circuit board which is less than the first predetermined distance, said tail end being engageable with and electrically coupled to an associated through hole in the printed circuit board, the through hole being coupled to ground potential for coupling each of said second and third contact members to the ground potential;

whereby, as said plug is moved toward said receptacle for mating engagement therewith, the first socket of said grounding block first receivably engages said second contact member, then said inner sleeve of said coaxial terminal receivably engages said first contact member, and finally the first socket of said grounding block receivably engages said third contact member, and vice versa as said plug is withdrawn from said receptacle, to thereby provide maximum electromagnetic shielding for each of the signal wires.

2. A controlled impedance connector assembly as set forth in claim 1 wherein each of said resilient contact members includes a plurality of longitudinally disposed resilient strip members spaced about the periphery of its associated said pin contact, each of said strip members being integral with said pin contact at its opposite ends and being bowed radially outwardly intermediate said opposite ends, said strip members being capable of coordinated radial movement to thereby achieve positive engagement with its associated said socket.

3. A controlled impedance connector assembly as set forth in claim 1 including:

fastener means for releasably mounting said receptacle on the printed circuit board.

4. A controlled impedance connector assembly as set forth in claim 1 wherein said receptacle includes:

a continuous wall integral with and upstanding from said base member and extending around the periphery thereof to thereby form a pair of opposed endwalls lying in substantially parallel planes and a pair of opposed sidewalls lying in substantially parallel planes; and a first partition upstanding from said base member extending between said sidewalls, generally parallel to and intermediate said endwalls, to thereby define a pair of side by side compartments for mating reception with the plug.

5. A controlled impedance connector assembly as set forth in claim 1 wherein the first and second sockets in said grounding block means are substantially cylindrical bores and have parallel spaced apart axes, each of the first sockets being laterally surrounded by four associated second sockets, all of the second sockets associated with each of the first sockets being equidistant, radially, from its associated first socket and at equally spaced circumferential distances around the first socket.

6. A controlled impedance connector assembly as set forth in claim 1:

wherein said receptacle includes:

a continuous wall integral with and upstanding from said base member and extending around the periphery thereof to thereby form a pair of opposed end walls lying in substantially parallel planes and a pair of opposed sidewalls lying in substantially parallel planes; and wherein said plug includes:

a housing having a foreside facing in the direction of said receptacle, an aft side facing away from said receptacle, a plurality of spaced parallel bores therein extending therethrough from said foreside to said aft side for engageably receiving said coaxial terminals therein, and a forward chamber adjacent said foreside, and including:

a grounding block releasably fixed to said plug in said forward chamber, said grounding block having a plurality of first sockets therein for engageably receiving said coaxial terminals and a plurality of second sockets therein for engageably receiving said ground pin contacts.

7. A plug as set forth in claim 6 wherein the plurality of first and second sockets in said grounding block include generally concentric arrangements, successively, of the first sockets and of the second sockets.

8. A controlled impedance connector assembly as set forth in claim 6:

wherein each of said first and second partitions has aligned transverse bores therethrough when said plug and said receptacle are matingly engaged; and fastener means receivable through said bores for releasably holding said plug in mating engagement with said receptacle.

9. A controlled impedance connector assembly as set forth in claim 6:

wherein said plug includes: an aft recess in said housing adjacent said aft side; and a gate member releasably fixed to said housing in said aft recess including a plurality of picket members engageable with said coaxial terminals when received in the bores in said housing and in the sockets in said grounding block to prevent withdrawal of said coaxial terminals therefrom.

10. A controlled impedance connector assembly as set forth in claim 9:

wherein said gate member includes:

a bight portion;

a plurality of picket members extending transversely from said bight portion;

wherein each of said coaxial terminals has an aft end; and wherein said housing includes track means for guiding said gate member from an inactive withdrawn position to an active position proximate to said aft side, said picket members being thereby engageable with said aft end of each of said coaxial terminals.

11. A controlled impedance connector assembly as set forth in claim 10 including:

mutually engageable locking means on said gate member and on said housing for releasably fixing said gate member in said active position.

12. A controlled impedance connector assembly as set forth in claim 6 wherein said plug includes:

extreme aft surface on said housing on a rear end thereof distant from said base member of said receptacle when mounted thereon;

a bracket member mounted on said aft surfaces of said housing;

first and second opposed mating clam shell covers overlying and enclosing said rear end of said housing, said covers being pivotally mounted on said bracket member for movement between open and closed positions, said first and second covers together including an outer wall and a collar integral with and extending away from said outer wall when said covers are in the closed position, said collar defining an outlet for a plurality of leads extending, respectively, from the coaxial terminals; and fastening means for releasably joining said first and second covers when said covers assume the closed position.

13. A controlled impedance connector assembly as set forth in claim 12 including:

strap means receivable around said collar and drawable into contiguous relationship therewith to complement said fastening means in maintaining said first and second covers in the closed position.

14. A controlled impedance connector assembly as set forth in claim 12 including:

a coaxial lead integral with each of said coaxial terminals and extending in a direction away from the printed circuit board, through said recess and through the outlet defined by said collar for termination at a location distant from the printed circuit board, a plurality of said leads being drawn together in a unitary bundle in contiguous parallel relationship intermediate said plug and said distant location; and an outer protective covering releasably applied to said bundle intermediate said plug and the connector station.

15. A controlled impedance connector assembly as set forth in claim 14 wherein said outer protective covering is composed of plastic sheet material and includes a closure mechanism operable for selectively opening said sheet material to expose said bundle of leads and for closing said sheet material into fitting and encompassing relationship about said bundle of leads to thereby hold them as a unit.

16. A controlled impedance connector assembly as set forth in claim 1 wherein said receptacle includes: a continuous wall integral with and upstanding from said base member and extending around the periphery thereof to thereby form a pair of opposed end walls lying in substantially parallel planes and a pair of opposed sidewalls lying in substantially parallel planes;

a first partition upstanding from said base member extending between said sidewalls, generally parallel to and intermediate said endwalls, to thereby define a pair of side by side compartments; and wherein said plug includes:

a housing having a front end and an aft end, a pair of side by side forward chambers at said front end, a pair of side by side recesses at said aft end, a plurality of spaced parallel bores therein extending from each of said chambers to its associated said recess for engageably receiving said coaxial terminals therein, and including:

a grounding block releasably fixed to said plug in each of said forward chambers, said grounding block having a plurality of first sockets therein for engageably receiving said coaxial terminals and a plurality of second sockets therein for engageably receiving said ground pin contacts, a second partition separating said forward chambers and said recesses;

said second partition having a recess extending the length thereof for receiving therein said first partition when said plug is moved toward said receptacle for mating engagement therewith, said front end of said plug being proximate to said base member.

17. A controlled impedance connector assembly as set forth in claim 16 wherein each of said first and second partitions has aligned transverse bores therethrough when said plug and said receptacle are matingly engaged;

fastener means receivable through said bores for releasably holding said plug in mating engagement with said receptacle.

18. A plug as set forth in claim 16 wherein the plurality of first and second sockets in said grounding block include generally concentric arrangements, successively, of the first sockets and of the second sockets.

19. A controlled impedance connector assembly as set forth in claim 16 wherein said plug includes: extreme aft surface on said housing on a rear end thereof distant from said base member of said receptacle when mounted thereon;

a bracket member mounted on said aft surfaces of said housing;

first and second opposed mating clam shell covers overlying and enclosing said rear end of said housing, said covers being pivotally mounted on said bracket member for movement between open and closed positions, said first and second covers together including an outer wall and a collar integral with and extending away from said outer wall when said covers are in the closed position, said collar defining an outlet for a plurality of leads extending, respectively, from the coaxial terminals; and fastening means for releasably joining said first and second covers when said covers assume the closed position.

20. A controlled impedance connector assembly as set forth in claim 19 including:

strap means receivable around said collar and drawable into contiguous relationship therewith to complement said fastening means in maintaining said first and second covers in the closed position.

21. A controlled impedance connector assembly as set forth in claim 19 including:

a coaxial lead integral with each of said coaxial terminals and extending in a direction away from the printed circuit board, through said recess and through the outlet defined by said collar for termination at a location distant from the printed circuit board, a plurality of said leads being drawn together in a unitary bundle in contiguous parallel relationship intermediate said plug and said distant location; and an outer protective covering releasably applied to said bundle intermediate said plug and the connector station.

22. A controlled impedance connector assembly as set forth in claim 21 wherein said outer protective covering is composed of plastic sheet material and includes a closure mechanism operable for selectively opening said sheet material to expose said bundle of leads and for closing said sheet material into fitting and encompassing relationship about said bundle of leads to thereby hold them as a unit.

23. A controlled impedance connector assembly as set forth in claim 1 including:

a coaxial lead integral with each of said coaxial terminals and extending in a direction away from the printed circuit board for termination at a location distant therefrom, a plurality of said leads being drawn together in a unitary bundle in a contiguous parallel manner intermediate the plug and said distant location;

an outer protective covering releasably applied to said bundle intermediate the plug and said distant location.

24. A controlled impedance connector assembly as set forth in claim 23 wherein said outer protective covering is composed of plastic sheet material and includes a closure mechanism operable for selectively opening said sheet material to expose said bundle of leads and for closing said sheet material into fitting and encompassing relationship about said bundle of leads to thereby hold them as a unit.

25. A controlled impedance connector assembly as set forth in claim 1 wherein said receptacle includes:

at least a pair of positioning pegs extending transversely of said base member for mutual reception with matching holes in the printed circuit board to assure proper positioning of said receptacle on the printed circuit board and thereby proper positioning for said tail ends of said signal pin contacts and said ground pin contacts for subsequent insertion into holes in the printed circuit board.

26. A controlled impedance connector assembly as set forth in claim 25 including:

standoff members having bearing surfaces for engagement with the printed circuit board, said base member being recessed relative to said bearing surfaces.

27. In a controlled impedance connector assembly, the improvement comprising:

a receptacle of dielectric material adapted to be mounted on a printed circuit board having a plurality of metallized through holes therein and including a planar base member lying generally parallel to and proximately spaced from a planar surface of the printed circuit board, said base member having a plurality of first and second laterally spaced mounted holes extending transversely therethrough, said receptacle adapted for mating engagement with a plug including a dielectric housing, an electrically conductive grounding block mounted in the housing having a plurality of first and second sockets extending transversely therethrough, and a plurality of coaxial terminals, each having an outer conductive sleeve permanently coupled to the outer braided shield of a coaxial cable lead and mechanically and electrically engageable with an associated one of the first sockets and an inner conductive sleeve electrically coupled to a signal wire;

a plurality of elongated signal pin contacts, each being fittingly received in an associated one of the first mounting holes in said base member and extending between a nose end and a tail end, said nose end having a first resilient contact member engageable with the inner sleeve of the coaxial terminal at a first predetermined distance away from the printed circuit board, said tail end of each of said signal pin contacts being engageable with an associated through hole in the printed circuit board and electrically coupled thereto;

a plurality of elongated ground pin contacts, each being fittingly received in an associated one of the second mounting holes and extending between a nose end and a tail end, said nose end of each of said ground pin contacts having second and third longitudinally spaced resilient contact members engageable with an associated one of the second sockets of the grounding block, each said second contact member being engaged with its associated second socket at a second predetermined distance away from the printed circuit board which is greater than the first predetermined distance, each said third contact member being engaged with its associated second socket at a third predetermined distance away from the printed circuit board which is less than the first predetermined distance, said tail end being engageable with and electrically coupled to an associated through hole in the printed circuit board, the through hole being coupled to a ground potential for coupling each of said second and third contact members to the ground potential;

whereby, as the plug is moved toward said receptacle for mating engagement therewith, the first socket of the grounding block first receivably engages said second contact member, then the inner sleeve of the coaxial terminal receivably engages said first contact member, and finally the first socket of the grounding block receivably engages said third contact member, and vice versa as the plug is withdrawn from said receptacle, to thereby provide maximum electromagnetic shielding for each of the signal wires.

28. A controlled impedance connector assembly as set forth in claim 27 wherein each of said resilient contact members includes a plurality of longitudinally disposed resilient strip members spaced about the circumference of its associated said pin contact, each of said strip members being integral with said pin contact at its opposite ends and being bowed radially outwardly intermediate said opposite ends, said strip member being capable of coordinated radial movement to thereby achieve positive engagement with its associate said socket.

29. A controlled impedance connector assembly as set forth in claim 27 including:

a coaxial lead integral with each of the coaxial terminals and extending in a direction away from the printed circuit board for termination at a location distant from the printed circuit board, a plurality of said leads being drawn together in a unitary bundle in a contiguous parallel manner intermediate the plug and said distant location;

an outer protective covering releasably applied to said bundle intermediate the plug and said distant location.

30. A controlled impedance connector assembly a set forth in claim 29 wherein said outer protective covering is composed of plastic sheet material and includes a closure mechanism operable for selectively opening said sheet material to expose said bundles of leads and closing said sheet material into fitting and encompassing relationship about said bundle of leads to thereby hold them as a unit.

31. A controlled impedance connector assembly as set forth in claim 27 including:

fastener means for releasably mounting said receptacle on the printed circuit board.

32. A controlled impedance connector assembly as set forth in claim 31 wherein said receptacle includes:

at least a pair of positioning pegs extending transversely of said base member for mutual reception with matching holes in the printed circuit board to assure proper positioning of said receptacle on the printed circuit board.

33. A controlled impedance connector assembly as set forth in claim 32 including:

standoff members having bearing surfaces for engagement with the printed circuit board, said base member being surfaces.

34. A plug assembly associated with a controlled impedance connector assembly and matingly engageable with a receptacle comprising:

a dielectric housing having a foreside facing in the direction of the receptacle, an aft side facing away from the receptacle including extreme aft surfaces, a plurality of spaced, parallel bores therein extending therethrough from said foreside to said aft side for engageably receiving the outer conductors of coaxial terminals therein, and a forward chamber adjacent said foreside;

an electrically conductive grounding block mounted in said forward chamber adjacent said foreside and coextensive with the opening at said front end, said grounding block having a plurality of first and second sockets extending therethrough transversely of a plane of the opening at said front end, each of the first sockets adapted to engageably receive for electrical connection thereto the outer conductor of the coaxial terminal, each of the second sockets adapted to engageably receive for electrical connection thereto a ground pin contact coupled to ground potential;

a bracket member mounted on said aft surfaces of said housing;

first and second opposed mating clam shell covers overlying and enclosing said rear end of said housing, said covers being pivotally mounted on said bracket member for movement between open and closed positions, said first and second covers together including an outer wall and a collar integral with and extending away from said outer wall when said covers are in the closed position, said collar defining an outlet for a plurality of leads extending, respectively, from the coaxial terminals; and fastening means for releasably joining said first and second covers when said covers assume the closed position.

35. A plug assembly as set forth in claim 34 including:

strap means receivable around said collar and drawable into contiguous relationship therewith to complement said fastening means in maintaining said first and second covers in the closed position.

36. A plug assembly as set forth in claim 34 wherein the plurality of first and second sockets in said grounding block include generally concentric arrangements, successively, of the first sockets and of the second sockets.

37. A plug assembly as set forth in claim 34 wherein the first and second sockets in said grounding block means are substantially cylindrical bores and have parallel spaced apart axes, each of the first sockets being laterally surrounded by four associated second sockets, all of the second sockets associated with each of the first sockets being equidistant, radially, from its associated first socket and at equally spaced circumferential distances around the first socket.

38. A plug assembly as set forth in claim 34 wherein said housing includes:

an intermediate transverse partition defining a pair of side by side forward chambers, one of said electrically conductive grounding blocks received in each of the chambers, said transverse partition having a bore therethrough; and fastener means receivable through the bore and engageable with the receptacle for releasably holding said housing in mating engagement with the receptacle.

39. A plug assembly as set forth in claim 38 including:

a coaxial lead integral with each of said coaxial terminals and extending in a direction away from the printed circuit board, through an associated one of said chambers and through the outlet defined by an associated one of said cables, for termination at a location distant from the printed circuit board, a plurality of said leads being drawn together in a unitary bundle in contiguous parallel relationship intermediate said plug and said distant location; and an outer protective covering releasably applied to said bundle intermediate said plug and said distant location;

40. A plug assembly as set forth in claim 39 wherein said outer protective covering is composed of plastic sheet material and includes a closure mechanism operable for selectively opening said sheet material to expose said bundle of leads and for closing said sheet material into fitting and encompassing relationship about said bundle of leads to thereby hold them as a unit.

41. A plug assembly as set forth in claim 38 including:

a coaxial lead integral with each of said coaxial terminals and extending in a direction away from the printed circuit board to a connector station distant therefrom, a plurality of said leads being drawn together in a unitary bundle in a contiguous parallel manner intermediate said housing and said distant location; and an outer protective covering releasably applied to said bundle intermediate said housing and said distant location.

42. A plug assembly as set forth in claim 41 wherein said outer protective covering is composed of plastic sheet material and includes a closure mechanism operable for selectively opening said sheet material to expose said bundle of leads and for closing said sheet material into fitting and encompassing relationship about said bundle of leads to thereby hold them as a unit.

43. In the production of a controlled impedance connector assembly, a combination of components comprising:

a receptacle of dielectric material adapted to be mounted on a printed circuit board having a plurality of metallized through holes therein, said receptacle also adapted for mating engagement with a plug and including a planar base member adapted for positioning generally parallel to and proximately spaced from a planar surface of the printed circuit board, said base member having an upper surface and a lower surface and a plurality of mounting recesses extending transversely through a part of said base member and open to said upper surface and smaller reception holes therein associated with each recess extending to said lower surface to enable communication between said upper surface and said lower surface;

a plurality of elongated pin contacts, each extending between a nose end and a tail end, said nose end having at least one resilient contact member engageable with an associated socket of the plug;

said tail end of each of said pin contacts being engageable with an associated through hole in the printed circuit board and electrically connected thereto, each said pin contact including an enlarged barrel member intermediate said nose end and said tail end;

a holding block having a planar engagement surface and a plurality of transverse bores formed therein, each bore adapted to engageably receive said resilient contact member of an associated one of said pin contacts; and stay means releasably supporting said holding block such that said engagement surface is generally parallel to and spaced from said upper surface and such that said tail end of each of said pin contacts is received in an associated one of the reception holes in said base member.

44. A combination of components as set forth in claim 43 wherein, when said holding block is selectively moved against the force of said stay means toward said base member such that said engagement surface engages said upper surface of said base member, said enlarged barrel member of each of said pin contacts is engageably received in an associated funnel shaped mounting recess in said base member and said tail ends of all of said pin contacts extend through and beyond the metallized through holes of the printed circuit board; and including:

solder applied to said tail ends and to the metallized through holes to thereby mechanically and electrically couple said tail ends to the printed circuit board;

whereby said holding block can thereupon be withdrawn from said base member so as to be disengaged from said pin contacts and removed from said combination of components.

45. A combination of components as set forth in claim 44 wherein said pin contacts include a plurality of signal pin contacts having a first said resilient contact member, each said first resilient contact member being engageable with an associated socket in the plug coupled to a signal lead at a first predetermined distance away from the circuit board; and wherein said pin contacts include a plurality of ground pin contacts having second and third longitudinally spaced resilient contact members, each pair of said resilient contact members being engageable with an associated socket in the plug electrically coupled to ground potential, each of said second contact members being engaged with its associated socket at a second predetermined distance away from the printed circuit board which is greater than the first predetermined distance, each of said third contact members being engaged with its associated socket at a third predetermined distance away from the printed circuit board which is less than the first predetermined distance.

* * * * *